US007021476B2

(12) United States Patent
Lloyd et al.

(10) Patent No.: US 7,021,476 B2
(45) Date of Patent: Apr. 4, 2006

(54) JIG AND A METHOD AND APPARATUS OF APPLYING A SURFACE TREATMENT TO A MEMBER ON THE JIG

(75) Inventors: Ian S Lloyd, Chester (GB); Graham N Jones, Chester (GB); Gordon Salt, Birmingham (GB); Tony Sadler, Birmingham (GB)

(73) Assignee: Airbus UK Limited, Bristol (GB)

( * ) Notice: Subject to any disclaimer, the term of this patent is extended or adjusted under 35 U.S.C. 154(b) by 74 days.

(21) Appl. No.: 10/311,021

(22) PCT Filed: Jun. 29, 2001

(86) PCT No.: PCT/GB01/02925

§ 371 (c)(1),
(2), (4) Date: Dec. 12, 2002

(87) PCT Pub. No.: WO02/08499

PCT Pub. Date: Jan. 31, 2002

(65) Prior Publication Data

US 2003/0141267 A1 Jul. 31, 2003

(30) Foreign Application Priority Data

Jul. 12, 2000 (GB) ..... 0016960

(51) Int. Cl.
*A47F 5/00* (2006.01)

(52) U.S. Cl. ..... 211/113; 118/500; 204/297.09; 204/297.1; 204/297.14

(58) Field of Classification Search ..... 211/113, 211/119; 204/297.06, 297.09, 297.1, 297.14; 118/500

See application file for complete search history.

(56) References Cited

U.S. PATENT DOCUMENTS

| | | | | | |
|---|---|---|---|---|---|
| 339,431 | A | * | 4/1886 | Ladd | 204/297.06 |
| 1,970,459 | A | | 8/1934 | Kelly | |
| 2,512,554 | A | * | 6/1950 | Schneider | 204/297.09 |
| 2,541,597 | A | | 2/1951 | Midling | |
| 2,858,266 | A | * | 10/1958 | Schneider | 204/297.09 |
| 3,118,545 | A | | 1/1964 | Rosner | |
| 3,133,007 | A | | 5/1964 | Creese et al. | |
| 3,272,733 | A | * | 9/1966 | Belke et al. | 204/297.1 |

(Continued)

FOREIGN PATENT DOCUMENTS

| | | | |
|---|---|---|---|
| DE | 2553276 | A | 5/1977 |
| DE | 7704346 | | 6/1977 |
| DE | 4117799 | A1 | 12/1992 |
| DE | 4218182 | A1 | 12/1993 |
| EP | 0094812 | | 11/1983 |
| EP | 0146437 | | 6/1985 |
| EP | 0517349 | A1 | 12/1992 |
| EP | 11229195 | | 8/1999 |

(Continued)

*Primary Examiner*—Robert W. Gibson, Jr.
(74) *Attorney, Agent, or Firm*—Nixon & Vanderhye P.C.

(57) ABSTRACT

A jig (10) is provided for holding an elongate member (56) to be surface treated. The jig (10) comprises a beam (12) and a plurality of hangers 14 spaced apart along the beam (12). The hangers (14) have supports (90) with retaining springs (96) thereon which are arranged to support and grip the elongate member (56). The beam (12) has hook-like members (18) for engagement with a lifting bar (30) of a crane (28). The crane (28) is used to transport the jig (10) to an anodising station (60) and subsequently to transport the jig (10) still with the anodised elongate member (56) thereon to a painting station. In that way, an elongate member to be surface treated can be manually placed on the respective supports (90) and held in place by the retaining springs (96) without having to use other forms of clamps.

10 Claims, 7 Drawing Sheets

U.S. PATENT DOCUMENTS

Figure 1:
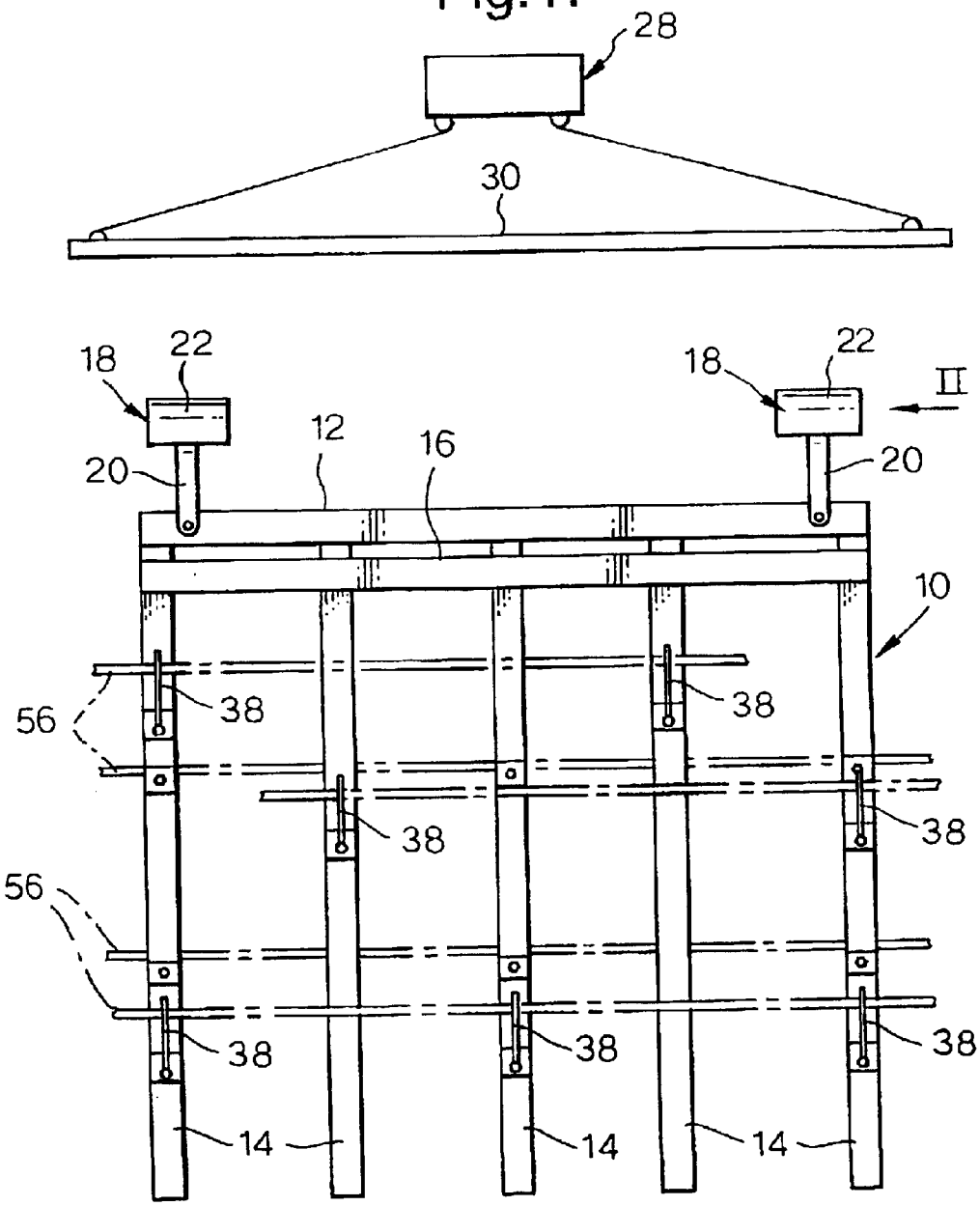

| | | | | | |
|---|---|---|---|---|---|
| 3,366,567 | A | * | 1/1968 | Elbaum | 204/297.07 |
| 3,496,082 | A | | 2/1970 | Orem et al. | |
| 3,923,631 | A | * | 12/1975 | Palisin, Jr. | 204/297.06 |
| 4,088,559 | A | | 5/1978 | Sandmeier et al. | |
| 4,377,461 | A | | 3/1983 | Lovejoy | |
| 4,402,541 | A | | 9/1983 | Bomberger et al. | |
| 4,407,229 | A | | 10/1983 | Sanborn | |
| 4,671,724 | A | | 6/1987 | Bolton | |
| 4,817,650 | A | | 4/1989 | Tilton | |
| 4,872,963 | A | | 10/1989 | Van Horn | |
| 5,020,677 | A | * | 6/1991 | Wirth et al. | 211/113 |
| 5,084,155 | A | | 1/1992 | Engwall | |
| 5,088,609 | A | | 2/1992 | Fryc | |
| 5,147,050 | A | * | 9/1992 | Cullen | 211/118 |
| 5,380,418 | A | | 1/1995 | Strecker | |
| 5,531,334 | A | | 7/1996 | Forby | |
| 5,908,120 | A | | 6/1999 | Yates et al. | |

FOREIGN PATENT DOCUMENTS

| | | | |
|---|---|---|---|
| FR | 2196202 | | 3/1974 |
| GB | 588001 | | 5/1947 |
| GB | 948195 | | 1/1964 |
| GB | 1056431 | | 1/1967 |
| GB | 1057148 | | 2/1967 |
| GB | 1475686 | | 6/1977 |
| GB | 2202863 | A | 10/1988 |
| GB | 2264506 | A | 9/1993 |
| JP | 60-77995 | | 5/1985 |
| JP | 60-213622 | | 10/1985 |
| JP | 8311697 | | 11/1996 |

* cited by examiner

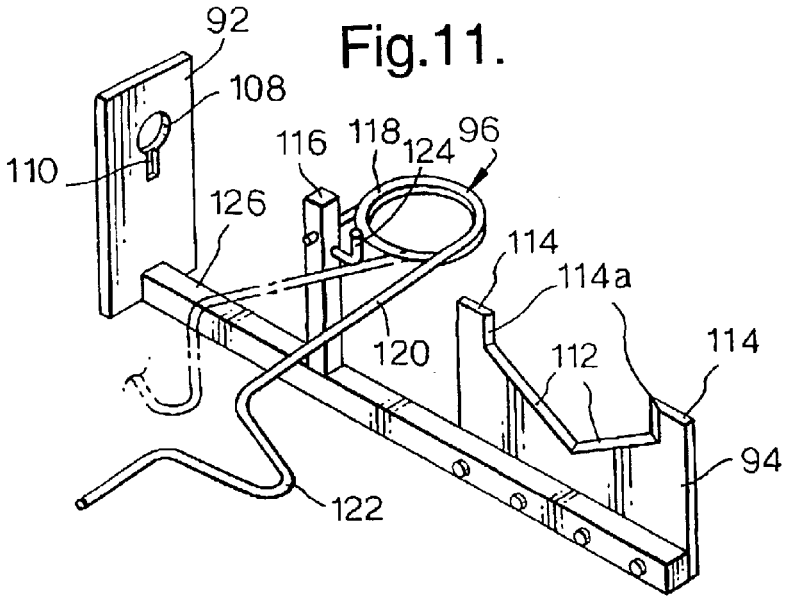
Fig.11.
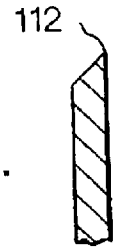
Fig.12a.
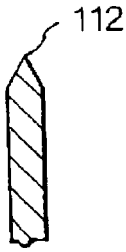
Fig.12b.
Fig.13.
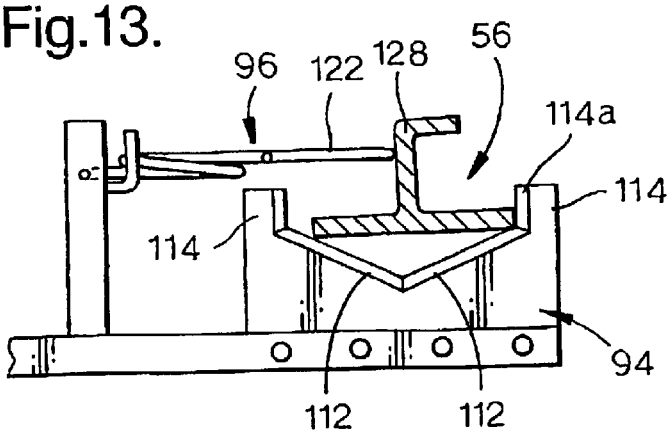
Fig.14.
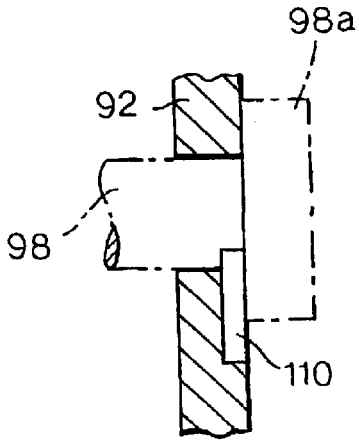

JIG AND A METHOD AND APPARATUS OF APPLYING A SURFACE TREATMENT TO A MEMBER ON THE JIG

This application is the US national phase of international application PCT/GB01/02925, filed in English on 29 Jun. 2001 which designated the US. PCT/GB01/02925 claims priority to GB Application No. 0016960.7 filed 12 Jul. 2000. The entire contents of these applications are incorporated herein by reference.

Anodisation is a process by which a hard non-corroding oxide film is deposited on a material such as aluminium or light alloy to protect against corrosion. It is achieved by making the material the anode in an electrolytic cell containing chromic (VI) or sulphuric acid and during anodisation an oxide film is deposited on the surface of the material.

In the aerospace industry, it is common for aluminium and light alloy members to be anodised prior to use in an aircraft so that the members will not be susceptible to oxidisation when the aircraft is in service.

In one known anodising method, wing stringers of an aircraft are mounted on an anodising jig. The anodising jig comprises a hanger having two downwardly depending beams connected to it. Each of the downwardly depending beams carries an identical metal tree mounting which consists of a vertical hanger and a plurality of horizontal supports extending therefrom. The horizontal supports are grouped into oppositely directed pairs which are spaced apart along the length of the hanger. All the supports of one tree mounting lie in the same plane. The supports of the other tree mounting are similarly arranged and lie in a plane parallel with that of the one tree mounting. Each support of one tree mounting has a corresponding support on the other tree mounting at the same level. A free end of each support has an upward projection, and upper surfaces of the supports are covered with an insulating material. This type of mounting is termed a "Christmas tree" mounting.

In use, a wing stringer is placed on the anodising jig so that part of the wing stringer is supported on one support of the first tree mounting and another part of the wing stringer is supported on a corresponding support of the second tree mounting. The insulating covering prevents direct contact between the wing stringers and the supports. Additional wing stringers are placed on adjacent empty supports in a similar manner. The upward projections on the supports prevent the wing stringers from sliding off the supports. If desired, the stringers can be further secured by tying for example with nylon string. Each of the wing stringers has a tooling tang at one of its ends, and the wing stringers are arranged on the jig so that all of the tooling tangs are arranged generally adjacent each other on the same side of one tree mounting.

A rigid electrical contact of serpentine form has spaced apart clamps connected thereto along its length in positions corresponding to the tooling tangs of all the wing stringers on the jig. In use, the tooling tang of each wing stringer is positioned in its corresponding clamp with flat surfaces of each tooling tang in contact with a flat surface of the rigid electrical contact and a flat surface of the associated clamp. The clamps of the electrical contact are tightened and the electrical contact is made ready for connection to a power supply.

The anodising jig is lowered into a tank of chromic acid solution and an electrical current provided by the power supply is passed through the electrical contact to the wing stringers. The wing stringers act as the anode and the tank chromic acid solution deposits an anodic film on the surface of the stringers. After an anodic film of sufficient thickness has been deposited on the wing stringers the anodising jig is removed from the tank. The electrical contact is then unclamped from the tooling tangs of the wing stringers and the wing stringers are removed from the jig.

A problem with the known anodising method is the time taken to individually clamp and unclamp the electrical contact to each wing stringer.

An aim of the invention is to provide an improved jig suitable for use in the surface treatment of an elongate member, such as a wing stringer.

According to a first aspect of the invention there is provided a jig for holding an elongate member to be surface treated, the jig comprising a beam and a plurality of hangers spaced apart along the beam, the hanger having respective V-shaped supports thereon which have an upstanding abutment on either side of the V and which are arranged to receive spaced apart sections of the elongate member and which provide a resilient grip for holding the member in position.

In that way, an elongate member to be surface treated can be manually positioned on the supports and held in position on the jig by the resilient grip without other forms of clamp.

In one embodiment, each support may comprise a resilient clip which grips the elongate member.

In another embodiment, the support may comprise a holder for the elongate member and a resilient member for retaining the elongate member against the holder.

In one embodiment of the present invention the support, primarily when in the form of resilient clips, actually provides an electrical contact by means of which electric current can pass, in use, between the holders and the elongate member. Therefore, the electric current is passed through the same means as that used to support the elongate member. The resilient clip is preferably of such a design as to support the component whilst permitting adequate conduction of electric current and, at the same time, presenting the minimum area capable of masking the elongate member during post anodising operations, such as painting.

Three or more hangers may be mounted on the beam at spaced apart positions so that the supports will, in use provide support for the elongate member at several places along its length.

Where the supports are in the form of resilient clips, each clip preferably comprises two spaced apart arms. At least one of said arms may be moveable resiliently with respect to the other to provide a clipping action. In a preferred embodiment the two arms of each resilient clip define a mouth. The mouth of each clip provides an entry into the clip to enable said part of the elongate member to be surface treated to be inserted easily into the clip. Preferably, the mouth faces upwardly whereby the said part of the elongate member can be inserted, from above, with the assistance of gravity, into each resilient clip.

In the preferred embodiment of resilient clip, upper ends of the arms of each resilient clip are preferably inclined away from each other so that the mouth is of increasing width from a relatively narrower part of the clip in which the elongate member is to be gripped when fully inserted in the clip. In that way, the elongate member such as a wing stringer can be rested in the mouth of each resilient clip prior to full insertion in the clip. Therefore, the position of the elongate member can be adjusted longitudinally relative to the jig by sliding it while resting in the mouths of the clips. Once in the correct position, each clip can be manipulated to allow the elongate member to be fully inserted and gripped in the clips.

In a preferred embodiment, one arm only of each resilient clip is movable resiliently relative to the other, the other being relatively immovable. In that arrangement and where the elongate member is to be inserted into each resilient clip by a single operative, the operative can use one hand to move the said one arm to open the clip while using the other hand to insert or guide the elongate member into the resilient clip.

The resilience of the clip can be effected by spring means acting on one of the arms. In such a case, the said one arm may be connected to a support for the clip through the spring means. In a preferred embodiment, the spring means is provided by forming part of the said one arm as a coil spring.

At least one of the arms may define a notch in which the elongate member is to be located for gripping by the clip. In a preferred embodiment, both arms of each clip have respective notches preferably at opposing positions.

Both arms of each resilient clip preferably have arcuate surfaces for gripping contact with the elongate member. With such an arrangement there will be virtually point or line contact only between the arms and the elongate member thereby increasing the percentage of the surface of the elongate member which is treatable when compared to the wing stringers and the supports of the prior art jig described in the introduction where there is a relatively larger surface to surface contact.

Where the jig is intended to hold elongate members such as heavy stringers or even wing spars, the jig preferably further comprises a plurality of supplemental supports. Each of the supplemental supports is preferably in the form of a pillar in the region of each resilient clip. The pillar is preferably arranged between the arms of the resilient clip and helps to support the elongate member when the latter is gripped by the clip. In that way, the supplemental supports can bear some of the weight of a heavy member and thus reduce stress on the resilient clips themselves.

Where each of the supports is in the form of a holder and resilient member, the holder may provide a narrow section which provides virtually point or line contact between the support and the elongate member, with the aforementioned advantages.

Edges of the V-shape may be narrowed to provide the said point or line contact.

The resilient member of the support may comprise a resilient arm which is arranged to contact the elongate member and urge it against a surface such as a surface of the holder.

If desired, the abutment may also have a narrow section to provide virtually point or line contact between itself and the elongate member.

Where each of the supports is in the form of a holder and resilient member, an electrical contact may be provided for attachment to each elongate member to enable electrical current to pass through the elongate member.

The vertical positions of the supports on their respective hangers is preferably adjustable. To provide such adjustment, the supports may be slidable vertically on the associated hanger and lockable in a desired adjusted position.

In the preferred embodiment of the invention, the jig is used to support elongate members to be anodised. Where electric current is to be conducted to the support, for example where the resilient clips are used, the beam, the hangers and the supports may all be of conductive material to allow electric current introduced to the beam of the jig and pass through the supports to the elongate member. Preferably the beam is made of aluminium and provides good electrical current conduction whilst keeping weight down to a minimum.

Preferably the beam, which helps give the jig structural rigidity, remains out of solution and does not become anodised.

Another problem which arises with the known anodising method is that the jig has to be de-anodised. The serpentine contact is made of aluminium and in order for the electrical contact to be made with a new batch of stringers, the insulating anodic film has to be removed before a new contact can be made. The current method of doing that involves a chemical stripping process, which also erodes the jig itself. Preferably, in the present invention, those parts of the jig that are submerged in chromic acid in use are made of Titanium which does not anodise in the same way that aluminium does and therefore does not require the same destructive method of anodic film removal prior to reuse.

At points or lines of contact between the support and the elongate member to be anodised there will be no anodic film deposited. Such points of contact will need to be treated separately for example in a process known as Alocroming using Alodine so as to complete the anodic film on the elongate member. Preferably, the jig is adapted so that between two and four supports are provided for each elongate member. In such a case, an elongate member to be anodised receives sufficient support while maintaining only a low number of contact points between the supports and the member.

The anodising jig previously used and described on page 1 hereof is fixed in situ in the anodising area. Therefore, where the elongate members need further processing, e.g. painting, in a different area, it is necessary to remove the elongate members from the jig and transport them to the other areas. In accordance with the present invention, the beam may have hook-like members spaced apart along the beam which are engageable with a lifting bar of a crane. The lifting bar can be lowered so as to engage in the hook-like members and then raised so as to lift the jig for transport between desired treatment stations for the elongate member on the jig.

Each hook-like member may be shaped somewhat like an upwardly pointing arrow head in vertical cross section having a shank attached at its lower end to the beam and a barb at its upper end defining an undercut for locating on the bar of the crane. Preferably, the barb defines two undercuts one on each side of the shank. In that way, the jig can be picked up using an undercut on one side and then put down on a suitable support which locates in the undercut on the other side. Therefore, the elongate members do not need to be put down in a rack for example thereby minimising the risk of contamination.

Normally, it is desirable to paint wing stringers after they have been anodised sufficiently. The prior art jig described on page 1 hereof is not suitable for use when painting the wing stringers as the large surface to surface contact between the supports and the wing stringers prevents paint from being applied to a significant part of the surface of the wing stringers. Instead, the wing stringers are removed from that jig and individually painted, which is inconvenient. Thereafter the jig needs to be de-anodised before it can be used again.

Another aim of the invention is to provide a more efficient way of applying a surface treatment and paint to an elongate member.

In that respect, the jig may form part of apparatus comprising a surface treatment station for treating the elongate member by an electrolytic process, a painting station, a first crane for transporting the jig to the surface treatment station and a second crane for transporting the jig with the surface treated elongate member thereon to the painting station.

According to a second aspect of the invention there is provided apparatus for applying a surface treatment and paint to an elongate member comprising a jig having a support for carrying an elongate member to be surface treated and painted, a surface treatment station for treating the elongate member by an electrolytic process, a painting station, a first crane for transporting the jig to the surface treatment station and a second crane for transporting the jig with the surface treated elongate member thereon to the painting station.

If a support is used which provides virtually point or line contact with the elongate member, the paint will be applied substantially to the entire elongate member leaving only the areas of point or line contact to be painted manually after removal of the elongate members from the jig. The invention is, therefore, particularly advantageous as it enables the same jig to be used for both line anodising and painting processes without having to handle the elongate members between the anodising and painting stages. Paint removal from the jig can be achieved simultaneously with removal of a thin anodised coating from the jig, if it is made of titanium.

A location device may be provided for locating the beam in a desired horizontal position relative to the tank. The location device may have features of the location device described below in relation to the surface treatment of a panel.

Preferably, the apparatus is in the form of an installation which is computer controlled.

The jig may comprise a jig in accordance with the first aspect of the invention or any of the subsidiary clauses relating thereto.

According to a third aspect of the invention there is provided a method of applying a surface treatment and paint to an elongate member, the method comprising the steps of providing a jig for carrying an elongate member to be surface treated and painted, mounting the elongate member to be surface treated on the jig, immersing the jig and elongate member in an electrolyte at a surface treatment station, introducing an electrical current to the jig so as to surface treat the elongate member, removing the jig from the electrolyte, transferring the jig with the treated elongate member thereon to a painting station, applying paint to the elongate member on the jig, removing the jig from the painting station and removing the painted elongate member from the jig.

In accordance with the third aspect of the invention, the elongate member is painted without removing it from the jig between the surface treatment and painting stations leading to a more efficient way of reaching the painting stage.

The method may involve using a first crane to transport the jig to the surface treatment station and a second crane to transport the jig to the painting station. Each crane may have a lifting bar which is engageable with hook-like members. In such a case, the method may comprise using the lifting bar of the first crane to locate beneath hook-like members of the jig and to lift and transport the jig to the surface treatment station and then using the lifting bar of the second crane to locate beneath the hook-like members after the lifting bar of the first crane has been detached therefrom to enable the second crane to lift the jig after the elongate member thereon has been surface treated and to transport the jig to the painting station.

The method may comprise using a jig in accordance with the first aspect of the invention or any of the subsidiary clauses relating thereto.

It is known to anodise and paint panels prior to use in an aircraft. A jig of known kind comprises a horizontal beam and aluminium straps depending therefrom. A panel is bolted to the straps. A crane lifts the jig into a tank of Chromic acid solution and the panel is anodised using the method described above.

Another aim of the invention is to provide improved apparatus for use in the surface treatment of a panel.

According to a fourth aspect of the invention, there is provided apparatus for use in the surface treatment of a panel, the apparatus comprising a beam having an upwardly projecting lifting member for location beneath a hook-like member which, in use, is attached to the panel, a treatment tank into which the panel is to be lowered and a location device for locating the beam in a desired horizontal position relative to the hook-like member.

The location device preferably comprises a horizontally moveable member which is moveable so as to clamp the hook-like member against a part of the beam. In a preferred embodiment, two of said horizontally moveable members are provided which are arranged to move towards each other to clamp the hook-like member against the part of the beam.

Preferably, electric current passes, in use, through the beam and from the beam preferably through the hook-like member to the panel. The aforesaid clamping of the hook-like member against the said part of the beam helps to maintain good electrical contact between the beam and the hook-like member.

Figure 2:
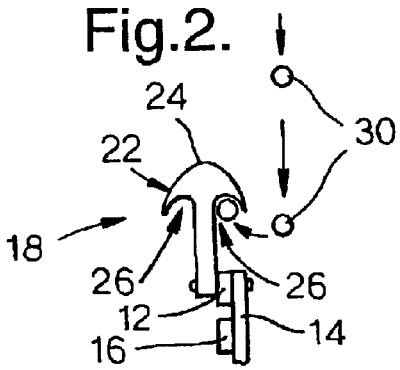
Figure 3:
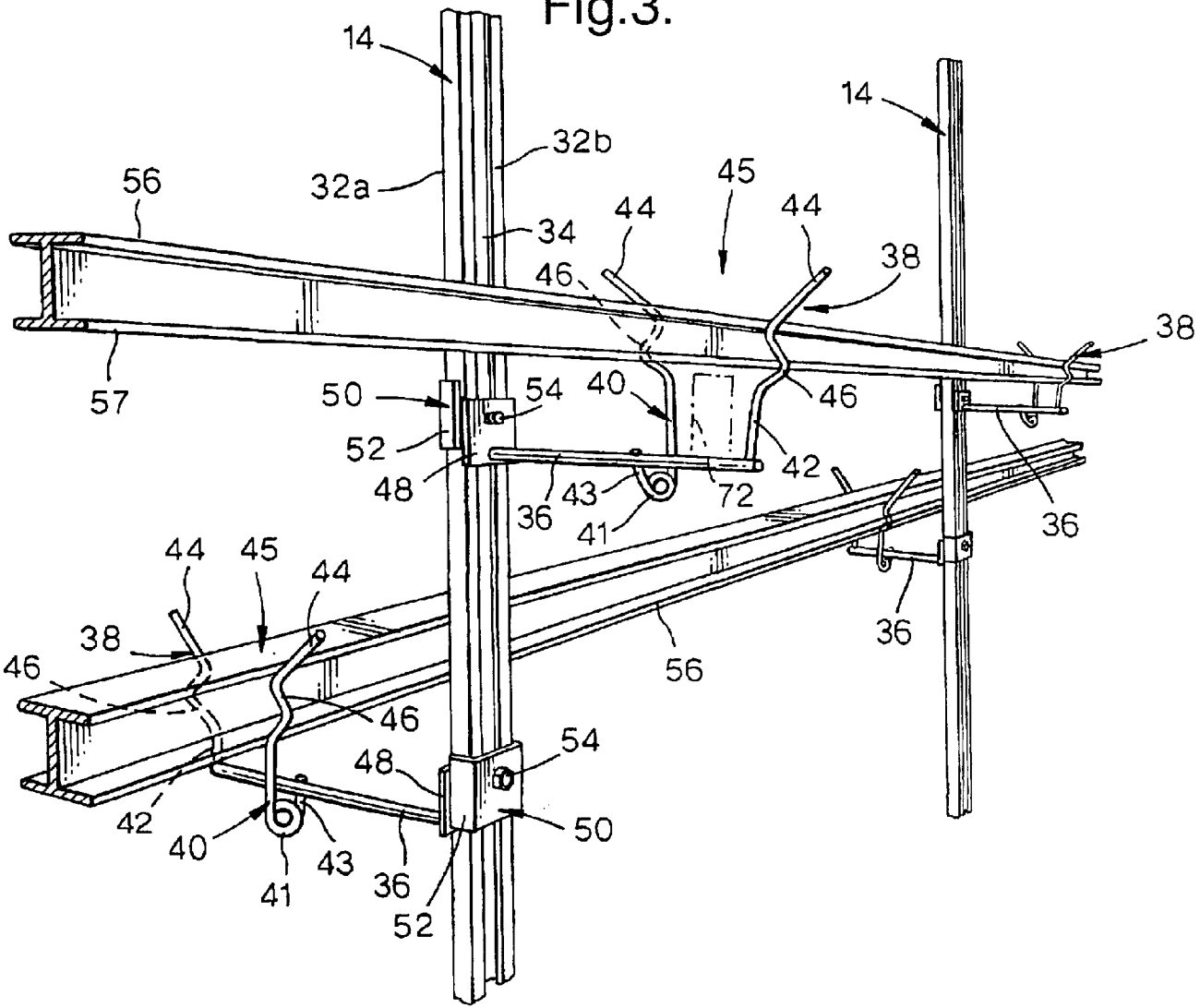
Figure 4:
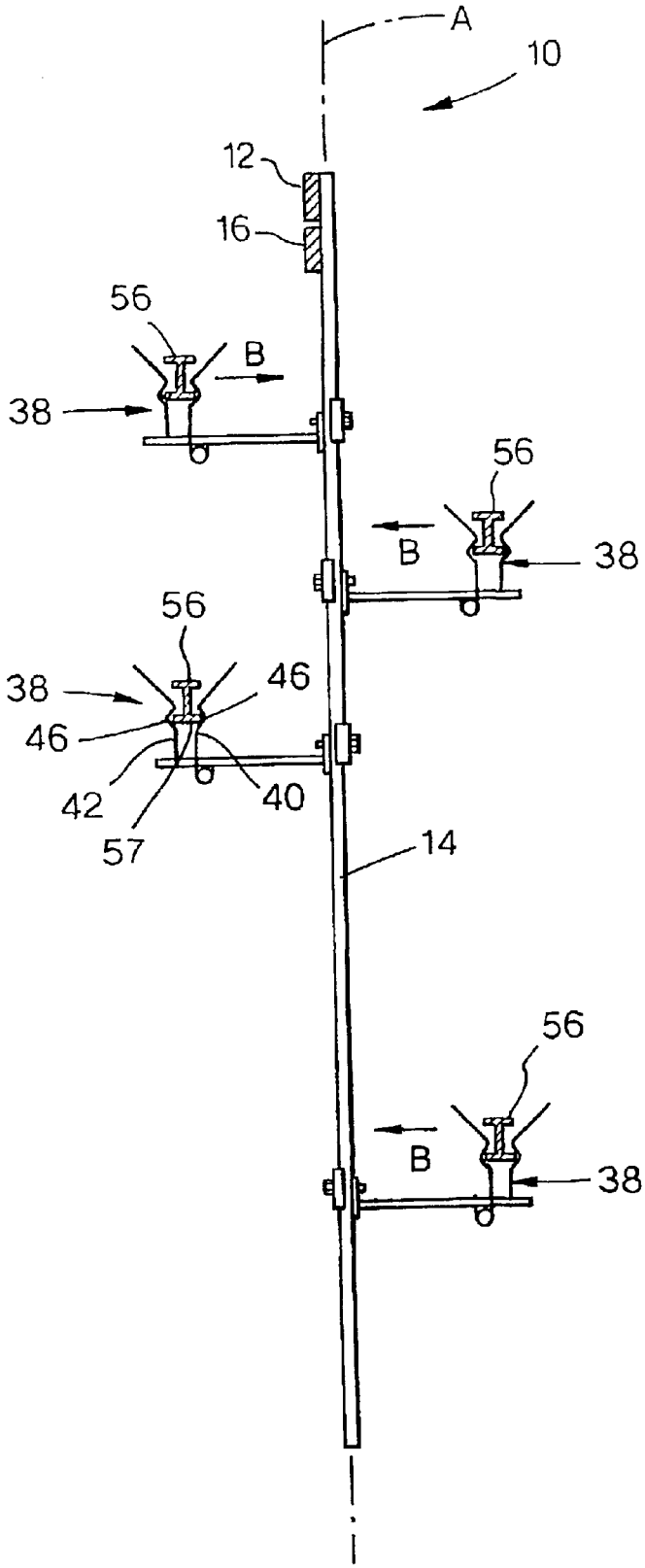
Figure 9:
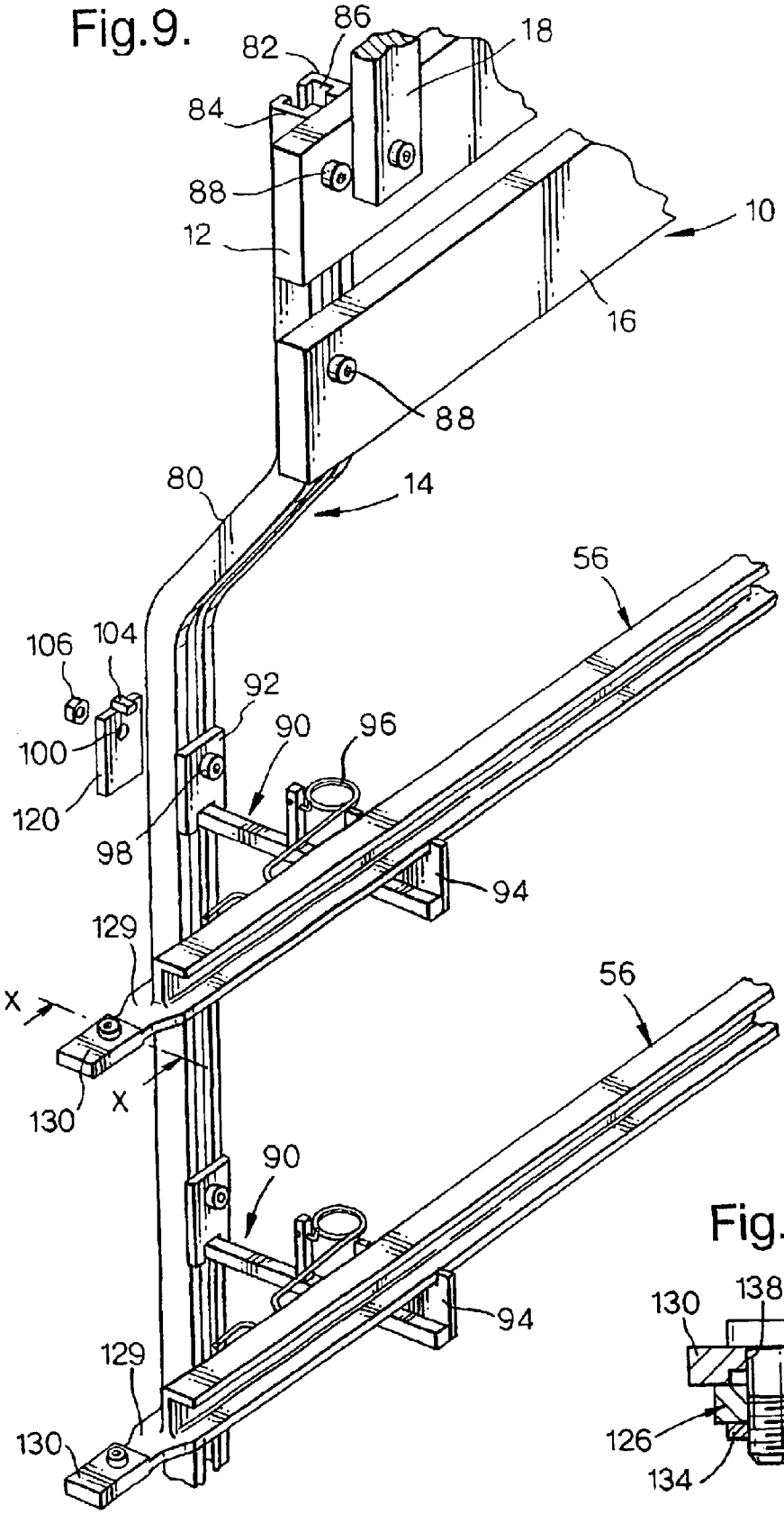
Figure 10:
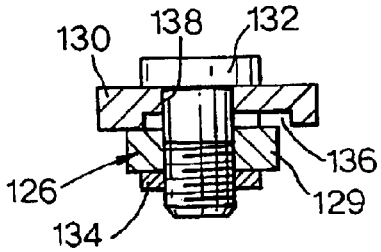
Figure 15:
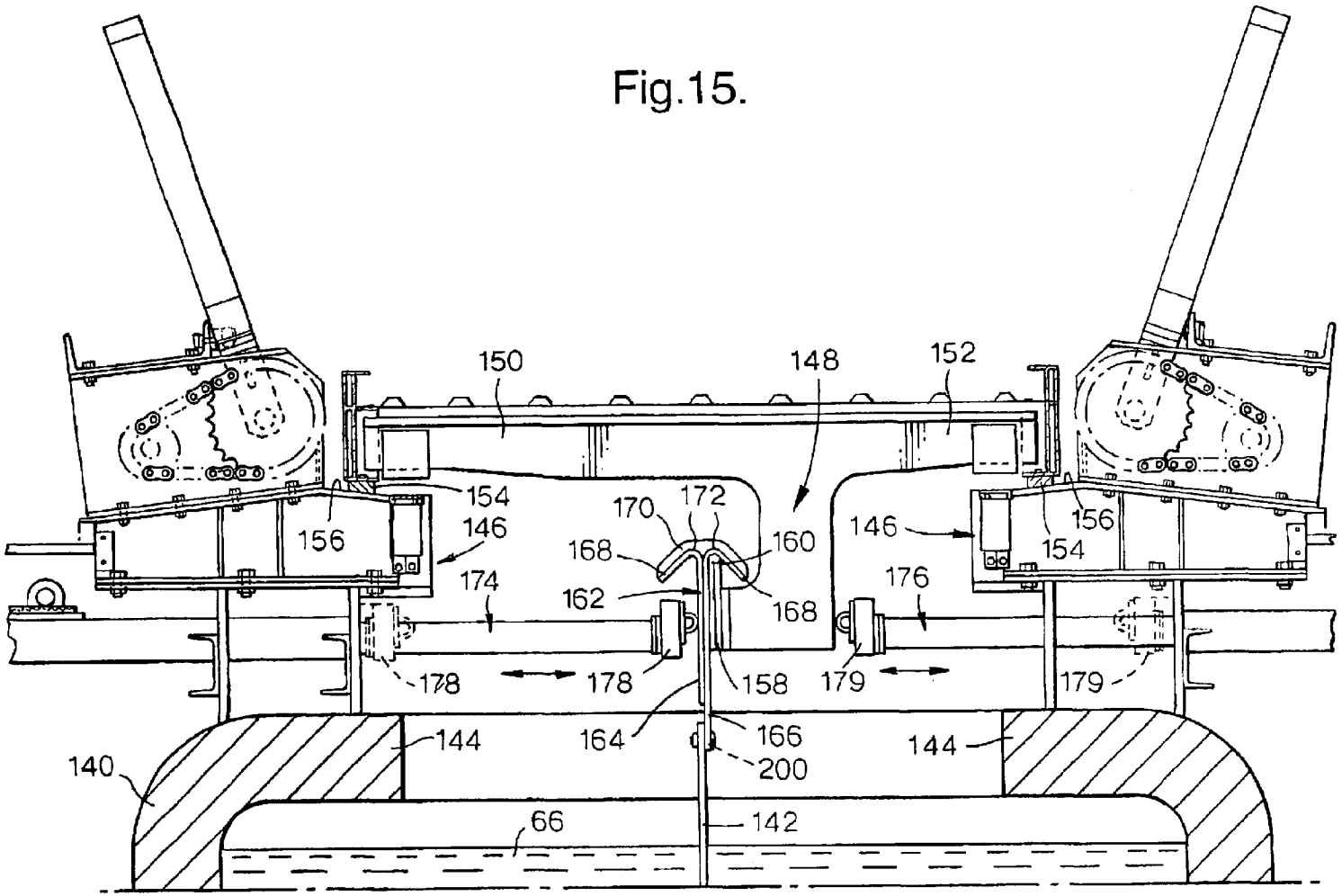

A jig, a method of applying a surface treatment to a member on the jig and apparatus for use in the surface treatment of a panel in accordance with the invention will now be described with reference to the accompanying drawings in which:

FIG. 1 is an elevation of a jig in accordance with the invention for use in anodising and painting an elongate member, FIG. 2 is an end view of part of the jig of FIG. 1 looking in the direction of arrow II in FIG. 1 and showing how a lifting bar of a crane locates on the jig, FIG. 3 is a perspective view showing part of the jig shown in FIG. 1 and showing wing stringers in position on the jig, FIG. 4 is an end view of the jig shown in FIG. 3 with additional wing stringers on the jig, FIGS. 5 to 8 are schematic views of an installation showing the jig at successive stages of anodising and painting, FIG. 9 is a perspective view of part of an alternative type of jig in accordance with the invention for use in anodising and painting an elongate member FIG. 10 is a cross-section through an electrical contact used in the jig of FIG. 9 on the line X—X in FIG. 9, FIG. 11 is a perspective view of a support which forms part of the jig of FIG. 9, FIG. 12 shows the way in which a V-shaped section of the support can have its edges formed, FIG. 13 illustrates the way in which a stringer can be held in place on the support, FIG. 14 shows the way in which a drainage groove is formed in a mounting plate for the support and FIG. 15 is a cross-section through part of a treatment tank showing the way in which a sheet or plate can be arranged for treatment therein.

Referring to FIG. 1 a jig 10 comprises a metal beam 12 and a plurality of hangers 14 depending from it. The hangers 14 are similar in length and hang parallel with each other in the same plane A (see FIG. 4) A secondary beam 16 is arranged beneath the beam 12 and is secured to the hangers 14 to ensure that the hangers 14 remain parallel. The metal beam 12 has two upwardly facing double-sided hooks known as arrows 18 fastened to opposite ends. Referring to FIG. 2, each of the arrows 18 has a shank 20 attached at its lower end to the beam 12 and having a barb 22 at its upper end, the barb 22 having a dome-like upper surface 24 and defining a pair of undercuts 26.

Referring to FIGS. 1 and 2 a gantry crane 28 carries a lifting bar 30 which is locatable in the undercuts 22 of the arrows 18 in a manner described below.

Referring now to FIG. 3, each hanger 14 comprises a pair of parallel titanium bars 32*a*, 32*b* spaced apart in the longitudinal direction of the metal beam 12 by spacers (not shown) to define a passage 34 therebetween. Each hanger 14 carries one or more supports 36 which project outwardly from the hanger and are spaced apart in the vertical direction. In the embodiment shown in FIG. 3, the supports 36 project from both sides of the hangers 14. Normally, the supports 36 on one hanger 14 will correspond in position with the supports 36 on the other hangers 14.

Each support 36 includes carries a resilient clip 38 which comprises a first arm 40 and a second arm 42. The first arm 40 is bent to form a coil spring 41 which has a free end 43 attached to the associated support 36. The first arm 40 can be moved resiliently away from the second arm 42 against the bias of the coil spring 41. The second arm 42 extends rigidly upwardly from the support 36 and is substantially immovable relative to the first arm 40. Each of the arms 40, 42 has an upper section 44 as viewed in the drawings, the upper sections 44 being bent away from the other to define a mouth 45 which defines an entry into the resilient clip 38. The arms 40, 42 are also bent to form opposing notches 46. The resilient clips 38 on one hanger 14 are positioned to corresponding with the positions of a resilient clips 38 on the same side of each of the other hangers 14.

Each support 36 extends from a mounting plate 48 on one side of its hanger 14. The plate 48 has an aperture (not shown) towards its upper edge. A clamping plate 50 has side flanges 52 which overlap the edges of its hanger 14 and is formed with a screw threaded aperture (not shown). The mounting plate 48 and clamping plate 50 are positioned on opposite sides of their hanger 14 so as to align their respective apertures. A fastener such as a bolt 54 is then passed through the aperture in the mounting plate 48, through the passage 34 and is screwed into the screw-threaded aperture in the clamping plate 50. Once the desired vertical position of each resilient clip 28 on its hanger 14 has been selected, the bolt 54 can be tightened to clamp the support 36 in that position.

Referring to FIGS. 1 and 3, wing stringers 56 for use in an aircraft are placed in the mouths 45 of respective clips 38 so as to rest on the upper sections 44 of the arms 40, 42. In that position, the wing stringers 56 can be moved longitudinally relative to the jig 10 so that they can be placed in the desired position. Once the wing stringers 56 have been correctly positioned, an operative applies a manual force to each arm 40 in the direction of arrow B in FIG. 4 to move the arm 40 against the bias of its coil spring 41. In that way, the clip 38 opens and the wing stringer 56 can be guided by the operative into the clip 38 so as to locate in the notches 46 of the clip. The operative then releases the arm 40 to allow the clip 38 to grip edges of a lower flange 57 of the wing stringer 56. In some cases, the clip 38 can be sprung open by a applying a downward force to the part of the wing stringer 56 in the mouth 45 so as to cause the upper sections 44 of the arms 40, 42 to spread apart and allow the wing stringer to snap into the notches 46.

The arms 40, 42 have no sharp edges and hence do not tend to cut into the wing stringers 56. A minimum of two and a maximum of four resilient clips 38 support each wing stringer 56 depending upon the length/weight of the wing stringer.

Once the wing stringers 56 are correctly loaded on to the jig 10, the lifting rail 30 of the crane 28 is lowered alongside each of the arrows 18 and manoeuvred underneath its barb 22. As the rail 30 is lifted it moves into the undercuts 26 of the arrows 18 and then begins to lift the jig 10.

Looking at the installation shown in FIGS. 5 to 8, it will be noted that in addition to the crane 28 there is a second gantry crane 58. The first crane 28 is used to transport the jig 10 through a cleaning station 59 (which may comprise several tanks) prior to anodisation to wash and remove grease and debris and an anodising station 60. The second crane 58 is used to transport the jig 10 through a painting station 62.

Figure 5:
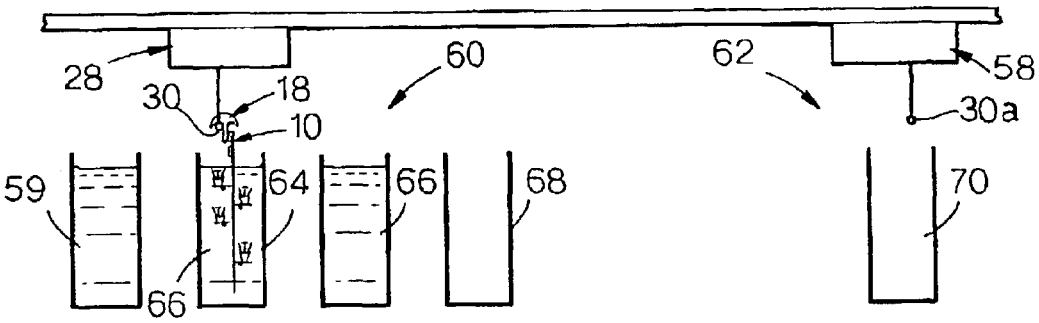
Figure 6:
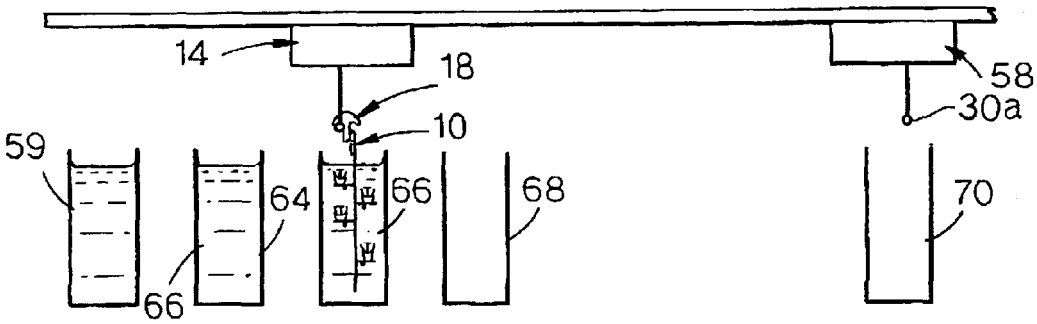
Figure 7:
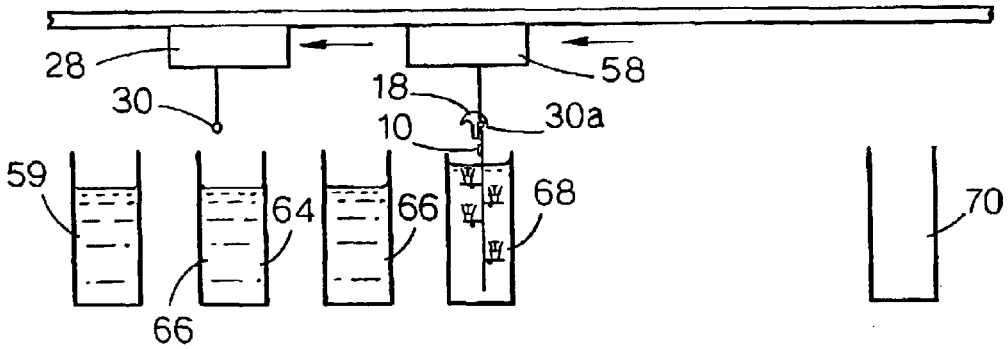
Figure 8:
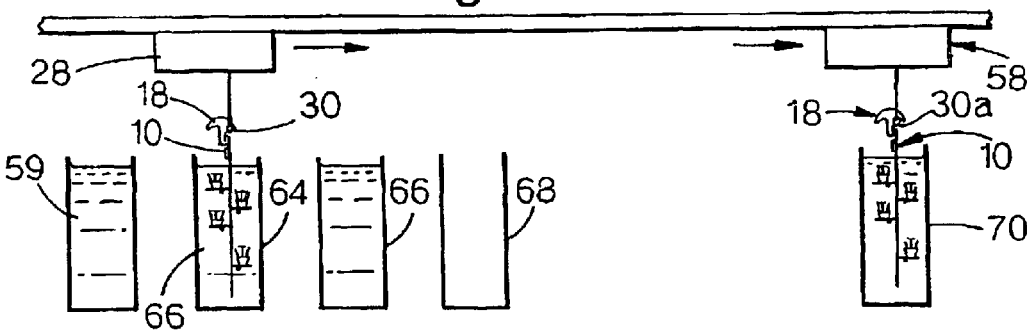

Initially, the crane 28 moves the jig 10 with its wing stringers 56 to the cleaning station 59 and then to a tank 64 at the anodising station 60, the tank 64 being filled with chromic acid solution 66 as shown in FIG. 5. The lifting bar 30 is arranged to receive electric current from a supply (not shown) and current is conducted from the lifting bar 30, through the arrows 18 and into the beam 12 which serves as a bus bar for the hangers 14. Electric current can then flow between the clips 38 and the wing stringers 56.

The jig 10 is lowered into the tank 64 and the electric current is then applied to the lifting bar 30. It will be appreciated that an electrolytic cell is formed whereby the wing stringers 56 become the anode and the chromic acid solution 66 acts as electrolyte causing an anodic film to be deposited on the wing stringers 56. After a desired time period has elapsed the jig 10 is removed from the tank 64. It will be appreciated that the areas of point/line contact between the resilient clips 38 and the wing stringers 56 are relatively small compared to that of known jigs (for example, the Christmas tree type jig described in the introduction) and so the anodic film will cover a greater percentage of the wing stringers 56. Additionally, since the jig 10 has a reduced bluff area in relation the tank it will not displace/remove as much Chromic acid solution from the bath as known jigs, when removed from the tank 64.

Next, the electric current is switched off and the first crane 28 lifts the jig 10 clear of tank 64. The first crane 28 then moves the jig 10 onward to one or more rinse tanks 66 to remove trace amounts of chromic acid solution. The jig 10 is then moved by the first crane 28 to a drying-off tank 68.

The lifting bar 30 of the first crane 28 is then moved clear of the arrows 18 of the jig 10 and a lifting bar 30*a* of the second crane 58 is then located in the undercuts 26 of the arrows 18. The second crane 58 then lifts the jig clear of the drying off tank 68 and moves the jig 10 to the painting station 62. As the second crane 58 moves to the painting station 62, the first crane 28 moves back to collect another jig 10 loaded with wing stringers 56 to be cleaned and anodised. The wing stringers 56 at the painting station 62 are painted in a booth or tank 70. The second crane 58 then lifts the jig 10 clear of the painting booth or tank 70 and finally moves the jig 10 out of the painting station 62 and transports it to a point where the finished wing stringers 56 can be removed from the jig. The lifting bar 30*a* of the second crane 58 is then moved clear of the arrows 18 and the second crane 58 moves back to collect the next jig 10 which has arrived at the drying-off tank 68.

At the points of contact between the arms 40, 42 of the resilient clip 38 and the wing stringers 56 (i.e. on the corners of the wing stringers) there will be no anodic film. Therefore after removal from the jig, a layer of film known as Alodine is then manually applied to the non-anodized parts and a layer of paint is applied at to the Alodine film.

The anodising process is preferably fully automated and the cranes 28, 58 are computer controlled. The first crane 28 and the second crane 58 work in parallel on the respective anodising and painting stages.

Each of the supports 36 on the hangers 14 may carry two or more resilient clips 38 if desired so that each support can bear additional wing stringers 56.

In another embodiment of the invention (not shown), where the supports 36 are intended to hold, say, heavy spars, a pillar 72 (FIG. 3) can be positioned on the support 36 between the arms 40, 42 so as to locate beneath and provide additional support to the heavy spar. The pillar 72 may be made of plastics material. Such a pillar 72 may be placed strategically rather than placed at every clip location on the jig 12.

For ease of cleaning, the hangers 14, supports 33, clips 38 and plates 48, 52 are made from titanium. Titanium is much easier to clean than aluminium and is resistant to anodising and paint bonding. Therefore, the cleaning of the jig 10 after the painting stage has been completed is a relatively straightforward job making it easy to return the jig quickly to the beginning of the anodising/painting cycle.

If desired, the arms 40, 42 may be covered by a suitable material such as plastics tubing to prevent any possible indentations on the wing stringers 56 when held in the clips 38. In such a case, electric current will need to be passed to the stringers 56 possibly by means of contact clips applied to a convenient point on the stringers.

Reference is now made to FIGS. 9 to 14 showing an alternative construction of FIG. 10. In FIGS. 9 to 14, parts corresponding to parts shown in FIGS. 1 to 8 carry corresponding reference numerals.

In FIG. 9, a metal beam 12 of FIG. 10 has a plurality hangers 14 depending from it as in FIG. 1, one hanger only being shown. In this embodiment, the hanger 14 has a dog-leg bend 80 formed near its upper end. As in FIG. 1, a secondary beam 16 is arranged beneath the beam 12 and is secured to the hangers 14 to ensure that the hangers 14 remain parallel. The beam 12 carries arrows 18 of a construction similar to that in FIG. 2.

Each hanger 14 comprises pair of parallel titanium bars 82, 84 which are held spaced apart by suitable spacers (not shown) at intervals so as to define a passage 86 therebetween. The hangers 14 are attached to the beam 16 by suitable fasteners 88 which extend through the passage 86. Each hanger 14 carries a plurality of supports 90 each of which includes a mounting plate 92, a V-shaped plate 94 and a retaining spring 96. The mounting plate 92 is attached to the hanger 14 by means of a fastener 98 which projects through the passage 86 and through an aperture 100 in a plate 102 which has a location tab 104 for locating in the passage 86. A suitable nut 106 is applied to the fastener and is tightened so as to secure the support 90 in a desired position on the hanger 14. As shown clearly in FIGS. 11 and 14 the mounting plate 92 is formed with an aperture 108 for the fastener 98 and a groove 110 is formed in the mounting plate 92 to serve as a drainage groove extending beneath a head 98*a* of the fastener 98 to facilitate drainage of liquid. The V-shaped plate 94 has two edges 112 arranged in a V and two vertical abutments 114. As shown in FIG. 12 the portion of the plate 94 defining the edges 112 is shaped in one of two ways so that the edges 112 will be very narrow. If desired, the inwardly facing edges 114*a* on the abutments 114 can be similarly formed as shown in FIG. 13. The retaining spring 96 has one end mounted on an upstanding member 116 and is formed as a coil 118 which leads to a straight section 120 which is formed with a retaining finger 122. If desired, the straight section 120 and finger 122 can be moved into an inoperative position by locating the straight section 120 behind a hook 124 on the member 116 as shown in broken lines in FIG. 11.

The V-shaped plate 94 and the projection 116 are suitably mounted on a square section bar 126 of the support 90 which projects from the mounting plate 92. The V-shaped plate 94, the projection 116, the retaining spring 96 and mounting plate 92 are of titanium.

FIGS. 9 and 13 show the way in which a wing-stringer 56 can be carried by the supports 90. Looking particularly at FIG. 13 the wing stringer 56 has a horizontal flange 126 which rests on the edges 112 of the V-shaped plate 94 and has a vertical flange 128 projecting upwardly from the horizontal flange 126. The retaining finger 122 of the retaining spring 96 is allowed to move into contact with the vertical flange 128 and apply a retaining load thereto which causes the right-hand edge of the horizontal flange 126 (as shown in the drawings) to press against the edge 114*a* of the abutment 114.

In that way, the weight of the stringer 56 is supported by the edges 112 and the stringer is held in position by means of the retaining spring 96.

As shown in FIGS. 9 and 10 the left-hand ends of the flanges 126 of the stringers 56 are formed with tangs 129 which receive electrical contacts 130. Each contact is attached to its stringer 56 by means of a fastener 132 which passes through the contact 130 and the flange 126, the contact 130 being held in position by a nut 134. A groove 136 is formed in the contact 130 and connects with an aperture 138 in the contact 130 which receives the fastener 132. The groove 136 provides drainage for liquid. The dog-leg bend 80 in each hanger 14 is designed so that the stringers 56 hang directly below the beams 12, 16 thereby enabling all of the stringers to be arranged on one side of the hangers 14. In that way, the dog-leg bend 80 ensures that the jig is vertically balanced and there is substantially no tendency for the hangers 14 to tip from the vertical.

It will be appreciated the narrow edges 112 and, where desired, the narrow edge 114*a* will provide point or line contact with the stringer 56 thereby minimising the areas which will not be anodised or painted on the jig.

The jig shown in FIGS. 9 to 14 is used in the same way as that of the earlier figures.

Looking now at FIG. 15, a tank 140 contains a chromic acid solution 66 for enabling a metal plate or sheet 142 (hereinafter called a plate) to be anodised. The tank 140 has an upper in-turned margin 144 which carries support arrangements 146 for a flight bar 148, the flight bar having support arms 150, 152 arranged at intervals along the length of the bar. FIG. 15 is a view looking in the longitudinal direction of the flight bar 148.

The arms 150,152 carry buffers 154 for contact with surfaces 156 of the support arrangements 146. The flight bar 148 has an elongate upwardly projecting lifting member 158 thereon having a curved upper end 160.

The plate 142 is attached to a plurality of spaced apart arrows 162 which each comprise two titanium plates 164, 166 joined together face-to-face and formed at their upper ends to provide downwardly projecting barbs 168. The barbs 168 are covered by an aluminium capping 170. The forming of the plates 164, 166 to provide the barbs 168 also forms curved surfaces 172 of complementary shape to the curved upper end 160 of the lifting member 158.

It will be noted the plate 166 of the arrow 162 extends downwardly beyond the plate 164. The plate 142 is joined to the plate 166 of the arrow 162 so that the plate 142 will be positioned as centrally as possible in relation to the arrow 162. In cases where the joint between the arrow 162 and plate 142 becomes immersed in the liquid of the treatment tank, an arrangement similar to that of FIG. 14 may be employed with drainage groove 200 being formed in the plate 142. The groove could however be formed in the arrow plate 166.

Each of the support arrangements 146 carries a location device, the location device on the left-hand side of the tank 140 being indicated at 174 and the location device on the right-hand side of the tank 140 being indicated at 176. The location devices 174, 176 are substantially identical. The location devices 174, 176 are movable horizontally towards and away from the flight bar 148 to ensure good electrical contact between the lifting member 158 and the arrows 162. This is achieved when the plate 166 of the arrow is pressed into intimate contact with the lifting member 158.

In use, and with the plate or sheet 142 being arranged outside the tank, a crane (not shown) lowers the flight bar 148 so as to position the lifting member 158 beneath barbs 168 of the arrows 162. The flight bar 148 is then lifted by the crane so that the lifting member 158 is urged upwardly into contact with the relevant curved surfaces 172 of the arrows 162 and the crane then carries the sheet 142 connected to the arrows 162 so that it is positioned above the tank 140. In that condition, the location devices 174, 176 are withdrawn so that ends 178, 179 occupy the broken line positions shown in FIG. 15. The flight bar 148 is then lowered until the buffers 154 of the arms 150, 152 come into contact with the surfaces 156. Once the flight bar is in position, the location devices 174, 176 are extended until the ends 176, 179 abut the arrow 162 and the flight bar 148 respectively. The ends 178, 179 are then urged firmly against the arrow 162 and the flight bar 148 respectively in order to clasp the arrow 162 firmly against the lifting member 158. In that way, electric current applied to the flight bar will flow through the lifting member 158, through the arrow 162 and to the plate 142. Anodising of the plate 142 in the chromic acid solution 66 then takes place.

After the anodising is complete, the location members 174, 176 are retracted and the flight bar 148 is raised by the crane so as to lift the plate 142 clear of the tank 140. The plate 142 can then be taken to a painting station.

Preferably, the tank 140 is used in a system similar to that shown in FIGS. 5, 6, 7 and 8 in place of the tank 66 and the cranes 28 and 58 can be used in the manner described with respect to those figures.

The arrows used in the embodiment described with respect to FIGS. 1 to 14 can, if desired, be constructed in a manner similar to the arrow 162 shown in FIG. 15.

A square pin passing through a square hole attaches each strap to its arrow and protects the user against possible injury by any unwanted scissor movement between strap and arrow, when the equipment is being dismantled or moved about.

It is envisaged that the jig of the invention could be used with other suitable members to be anodised, either for an aircraft or otherwise.

What is claimed is:

1. A jig for holding an elongate member to be surface treated, the jig comprising a beam and a plurality of hangers spaced apart along the beam, each hanger having respective V-shaped supports thereon which have an upstanding abutment on either side of the V and which are arranged to receive spaced apart sections of the elongate member and which provide a resilient grip for holding the member in position.

2. A jig according to claim 1 in which each support includes a resilient clip which grips the elongate member.

3. A jig according to claim 2 in which the resilient clips provide electrical contact with the elongate member.

4. A jig according to claim 1 in which a contact edge of the support is narrowed to provide point or line contact with the elongate member.

5. A jig according to claim 1 in which the resilient grip is provided by an arm which is arranged to contact the elongate member and urge it against a said upstanding abutment.

6. A jig according to claim 1 in which the vertical positioning of the supports on their respective hangers is adjustable.

7. A jig according to claim 3, in which the jig is used to support elongate members to be surface treated in an electrolyte and the beam, the hangers and the resilient clips are all of electrically conductive material.

8. A jig according to claim 1 in which the jig is at least partly of titanium for ease of cleaning.

9. A jig according to claim 1 in which the beam has hook-like members spaced therealong engageable with a lifting bar of a crane.

10. A jig according to claim 9 in which each hook-like member is shaped like an upwardly pointing arrow head in vertical cross section having a shank attached at its lower end to the beam and a barb at its upper end defining one or more oppositely facing undercuts for locating on the lifting bare of the crane.

* * * * *